US009506262B2

(12) United States Patent
Tavor et al.

(10) Patent No.: US 9,506,262 B2
(45) Date of Patent: Nov. 29, 2016

(54) SWIMMING POOL CLEANER WITH DIRT DETECTION SYSTEM

(71) Applicant: Aquatron Robotic Systems Ltd., Afula Illit (IL)

(72) Inventors: Avraham Tavor, Afula Illit (IL); Shahar Schloss, Afula Illit (IL); Benjamin Attar, Kiryat Bialik (IL)

(73) Assignee: AQUATRON ROBOTIC SYSTEMS LTD., Afula Illit (IL)

( * ) Notice: Subject to any disclaimer, the term of this patent is extended or adjusted under 35 U.S.C. 154(b) by 0 days.

(21) Appl. No.: 14/590,486

(22) Filed: Jan. 6, 2015

(65) Prior Publication Data

US 2015/0191927 A1 Jul. 9, 2015

(30) Foreign Application Priority Data

Jan. 7, 2014 (EP) ..... 14150366

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654
USPC ..... 15/1.7
See application file for complete search history.

(56) References Cited

U.S. PATENT DOCUMENTS

| | | | |
|---|---|---|---|
| 5,613,261 A | 3/1997 | Kawakami et al. | |
| 8,393,036 B2 | 3/2013 | Mastio et al. | |
| 8,438,684 B2 | 5/2013 | Mastio et al. | |
| 2004/0040581 A1* | 3/2004 | Bruwer | E04H 4/1663 134/18 |
| 2005/0166355 A1 | 8/2005 | Tani | |
| 2011/0162683 A1 | 7/2011 | Mastio et al. | |
| 2013/0152970 A1 | 6/2013 | Porat | |
| 2014/0014140 A1 | 1/2014 | Correa | |
| 2014/0076789 A1 | 3/2014 | Shlomi-Shlomi et al. | |
| 2014/0166045 A1* | 6/2014 | Herring | E04H 4/1654 134/1 |
| 2014/0263087 A1 | 9/2014 | Renaud et al. | |

FOREIGN PATENT DOCUMENTS

| | | |
|---|---|---|
| EP | 1540612 B1 | 12/2009 |
| EP | 2725169 A2 | 4/2014 |
| WO | WO 2004/019295 A1 | 3/2004 |
| WO | WO 2014/004929 A2 | 1/2014 |

OTHER PUBLICATIONS

Extended European Search Report. EPO search report for EP 14150366.4 Sep. 2014.

* cited by examiner

*Primary Examiner* — Laura C Guidotti

(74) *Attorney, Agent, or Firm* — Abelman, Frayne & Schwab

(57) ABSTRACT

A swimming pool cleaner comprising a housing (1, 2), drive means (4, 41), a water inlet (11), a water outlet (12), a filter (20) and a pump (3), arranged so that, in a first operation mode of the swimming pool cleaner, the pump (3) displaces water from said inlet (11) to said outlet (12) through said filter (20), so that debris entering with the water is retained in a first part of said filter (20). A dirt sensor (6) is provided to trigger switching between at least two cleaning programs.

7 Claims, 9 Drawing Sheets

SWIMMING POOL CLEANER WITH DIRT DETECTION SYSTEM

TECHNICAL FIELD

The present invention relates to swimming pool cleaners.

STATE OF THE ART

Swimming pools require cleaning, often on a daily basis. It is known in the art to use swimming pool cleaners that include some kind of drive system for displacing the swimming pool cleaner throughout the swimming pool, for example, by moving over the bottom surface of the swimming pool and, in the case of some types of swimming pool cleaners, also on the side walls of the swimming pool, and/or floating in the water of the swimming pool. Some swimming pool cleaners include drive means based on some kind of pump device that produces a water jet for displacing the swimming pool cleaner; for example, the water jet can be provided by an on-board pump driven by an electric motor, or by external pressure provided by the pool circulation pump or an independent pump. Other swimming pool cleaners include one or more motors for actuating drive devices such as wheels for driving the swimming pool cleaner so as to displace it over a surface; for example, the motor or motors can be electric or hydraulic, for example, driven by a water turbine with pressure being provided by an external pump.

Swimming pool cleaners generally include, internally or externally, at least one pump device arranged to pump or suck water into the swimming pool cleaner through at least one water inlet and to expel water through at least one water outlet, filtering means being arranged between the inlet and the outlet so as to retain debris, such as dirt particles, leaves, etc.

Swimming pool cleaners should be as efficient as possible in terms of power consumption and in terms of cleaning capacity, and they should also be as user-friendly as possible, requiring a minimum of maintenance and allowing for maintenance to be performed under user-friendly conditions.

Pool cleaners generally operate according to pre-established and fixed programs, for example, scanning the floor of the swimming pool according to a pre-set program or arbitrarily. As the floors of swimming pools generally have a fairly constant structure and similar characteristics all throughout the swimming pool, this has traditionally been considered appropriate and practical. Thus, and in contrast with other objects to be cleaned, such as in the case of autonomous floor cleaners (as disclosed in, for example, US-2005/0166355-A1 and U.S. Pat. No. 5,613,261-A), where the operation of the device is adapted according to dust or dirt present in the area being cleaned, for swimming pools it has traditionally been considered sufficient to operate according to a fixed program. EP-1540612-B1 teaches a swimming pool cleaner provided with an on-board sensor, but the sensor is not used for optimizing the operation of the swimming pool cleaner but just to collect data regarding characteristics and conditions of the water in the pool.

However, it has been found that it may often be the case that in spite of the generally homogeneous character of the floor of a swimming pool, some areas of a swimming pool may actually be substantially more dirty than other areas. This means that with known swimming pool cleaners, too much time may be spent on cleaning less dirty areas, and/or insufficient time may be spent on cleaning more dirty areas. It has been found that known swimming pool cleaners may not be fully efficient in what regards, for example, time and energy consumption. It is also considered that there is a risk that one or more areas of the swimming pool be left dirtier than desired after completion of a cleaning cycle.

US-2013/0152970-A1 discloses how the energy consumption of a swimming pool cleaner can be reduced by adapting the operation of a pump in response to the detection of a foreign object, but it has been found that further enhancement of efficiency is desirable.

WO-2014/004929-A2 discloses a sophisticated pool cleaner with a laser range finder. The system can include a controller, a laser range finder including a first laser, a second laser, and a camera. The control system can be located on or in the pool cleaner and can optimize operation of the pool cleaner by mapping a swimming pool or spa environment and accurately positioning the pool cleaner throughout the environment. The control system can allegedly optimize cleaning routes and identify specific locations of debris within the environment. The controller can operate and receive inputs from the laser range finder and/or a second sensor assembly, and can operate a directional control mechanism to move the pool cleaner along a desired route within the underwater environment based on these inputs. The control system can allegedly determine and optimize cleaning routes and operate the pool cleaner to follow these optimized cleaning routes. The system involves the projection of two laser lines on an object, the capturing of images of the projected lines, and the calculation of a distance to an object based on a calculated pixel distance. The system allows for mapping using simultaneous localization and mapping (SLAM) techniques.

DESCRIPTION OF THE INVENTION

The invention relates to a swimming pool cleaner comprising a housing,
drive means for displacing the swimming pool cleaner,
at least one water inlet,
at least one water outlet,
at least one filter, and
at least one pump.

Any kind of drive means is within the scope of the present invention, as long as it is suitable for displacing the swimming pool cleaner. For example, the drive means can include one or more electric motors and/or wheels, such as wheels driven by one or more electric motors. The drive means can include means for generating a water jet or similar to displace the swimming pool cleaner; the means for generating a water jet or similar can include an internal or external pump. In some embodiments of the invention, the drive means comprise hydraulically driven wheels, for example, wheels that are driven by an external pump. The invention is not limited to any specific kind or type of drive means; for example, also swimming pool cleaners without wheels, such as swimming pool cleaners arranged to float in the water of a swimming pool, are within the scope of the invention.

The term pump has to be interpreted in a generic sense, as including any device suitable for displacing water.

The water inlet, water outlet, filter and pump are arranged so that, in at least one operation mode of the swimming pool cleaner, said at least one pump displaces water from said water inlet to said water outlet through said filter, so that debris entering the water inlet with the water is retained in said filter.

In accordance with the invention, the swimming pool cleaner further comprises a dirt detector, and the swimming pool cleaner is arranged or configured to selectively operate according to one of a plurality of available cleaning programs, selected as a function of an output from said dirt detector. This helps to enhance efficiency of the pool cleaner. It has been found that sometimes, in swimming pools, dirt may be concentrated in one or more areas, or at least distributed so that there is more dirt in some areas than in other areas. Thus, a swimming pool cleaner operating in the same way throughout the swimming pool may not clean some areas sufficiently, or may spend too much time and/or power on cleaning the less dirty areas, thereby operating with sub-optimal efficiency. Thus, and whereas traditional swimming pool cleaners can produce acceptable results in terms of cleaning if they are allowed to operate for a sufficiently long time, by using a dirt detector, the swimming pool cleaner can adapt the way in which it operates in accordance with the level of dirt that is detected, for example, in terms of turbidity. Turbidity sensors are well known in the art of washing machines or dishwashers, and many commercially available ones can be readily applied to pool cleaners. In some embodiments of the invention, the dirt sensor can be used to determine when the swimming pool cleaner is to be set in a backwash mode. In many embodiments of the invention, the dirt sensor is arranged in correspondence with a water inlet, for example, within a body or housing of the swimming pool cleaner, for example, close to a water inlet, so as to be responsive to the amount or concentration of dirt in the water that is entering into the filter. Thus, the dirt sensor can be housed safely within the body or housing of a swimming pool cleaner, while being able to reliably detect dirt entering with the water flow.

In some embodiments of the invention, at least one of said available cleaning programs is arranged for driving the swimming pool cleaner, via said drive means, with a first speed, and at least another one of said available cleaning programs is arranged for driving the swimming pool cleaner, via said drive means, with a second speed, different from said first speed.

In some embodiments of the invention, at least one of said available cleaning programs is arranged for driving the swimming pool cleaner in accordance with a first scanning pattern and at least another one of said available cleaning programs is arranged for driving the swimming pool cleaner in accordance with a second scanning pattern, different from said first scanning pattern.

That is, the swimming pool cleaner can be configured to operate in accordance with one of a plurality of available cleaning programs, such as two or more different cleaning programs, the cleaning program being selected based on the output from the dirt detector. Thus, for example, the pool cleaner can spend more time in the dirtier areas of the swimming pool than in the less dirty areas of the swimming pool. The cleaning programs can differ from each other in terms of, for example, the driving speed with which the swimming pool cleaner is made to move (for example, over the floor of the swimming pool or floating in the water of the swimming pool, using the drive means), and/or the pattern which the swimming pool cleaner follows when moving in the swimming pool, that is, the scanning pattern.

BRIEF DESCRIPTION OF THE DRAWINGS

To complete the description and in order to provide for a better understanding of the invention, a set of drawings is provided. Said drawings form an integral part of the description and illustrate embodiments of the invention, which should not be interpreted as restricting the scope of the invention, but just as examples of how the invention can be carried out. The drawings comprise the following figures.

DESCRIPTION OF A WAY OF CARRYING OUT THE INVENTION

Figure 1A:
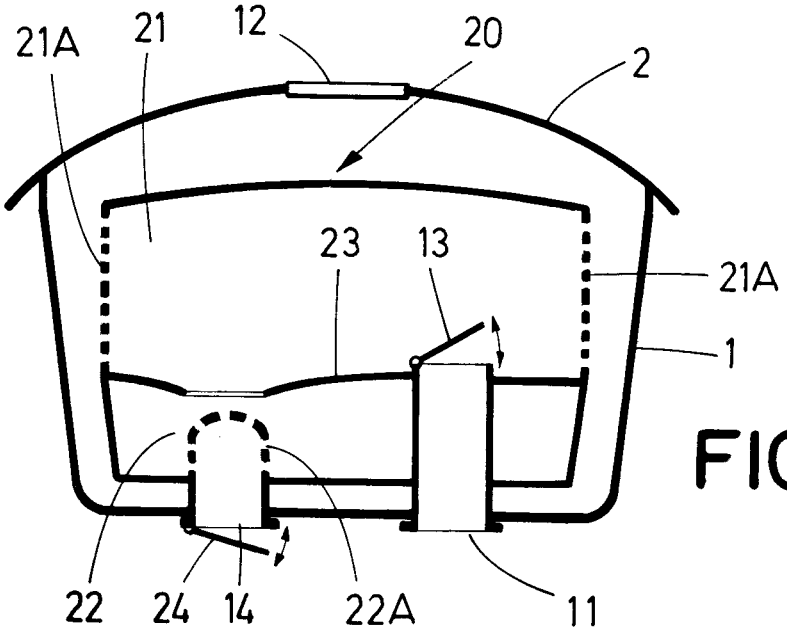
FIGS. 1A-1C schematically illustrate the operation of a swimming pool cleaner according to a first embodiment of the invention.

As shown in FIG. 1A, a swimming pool cleaner in accordance with an embodiment of the invention comprises a housing 1 with a removable or pivotably arranged cover 2, a water inlet 11 and a first water outlet 12, with a non-return device 13 being arranged in correspondence with said water inlet. Also a second water outlet 14 is provided. The swimming pool cleaner includes a dirt detector, schematically illustrated in FIG. 3A.

Inside the housing there is a motor (not shown) for driving the swimming pool cleaner or robot over the floor of the swimming pool, and a pump (not shown), as well as a filter 20 comprising a first chamber 21 and a second chamber 22, separated by a partition wall 23 in which an opening is provided which allows water to flow from the first chamber 21 to the second chamber 22. The second chamber 22 is in fluid connection with the second water outlet 14 through a filter wall 22A which extends into the second chamber 22, upwards from the floor of the second chamber 22, so as to make sure that it will not be clogged by debris deposited on the floor of the second chamber. A non-return device 24 is provided at the second water outlet 14, to prevent water from entering when the pool cleaner is operating in the first operation mode.

The first chamber 21 has lateral filtering walls 21A. The filter 20 can be removed by opening the cover 2 and lifting the entire filter 20 out of the housing 1.

Figure 1B:
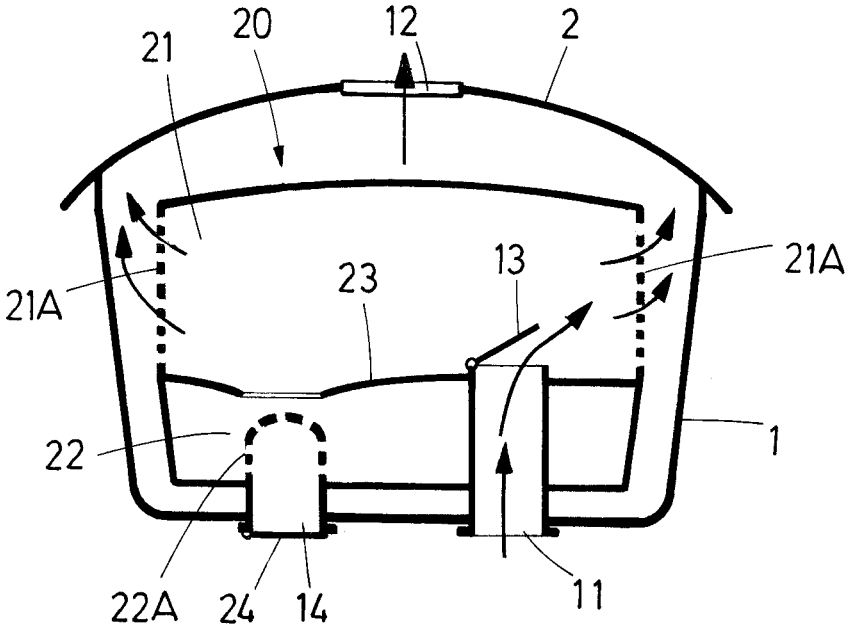

FIG. 1B shows how water flows when the pool cleaner is in a first operation mode, in which the pump is driving water from the water inlet 11 to the first water outlet 12. Here, the water is pumped through the first chamber 21 of the filter 20, and filtered through the filtering walls 21A, so that debris is retained in this first part of the filter, that is, in said first chamber 21. The water that exits through said filtering walls 21A leaves the housing of the pool cleaner through said first water outlet 12.

Figure 1C:
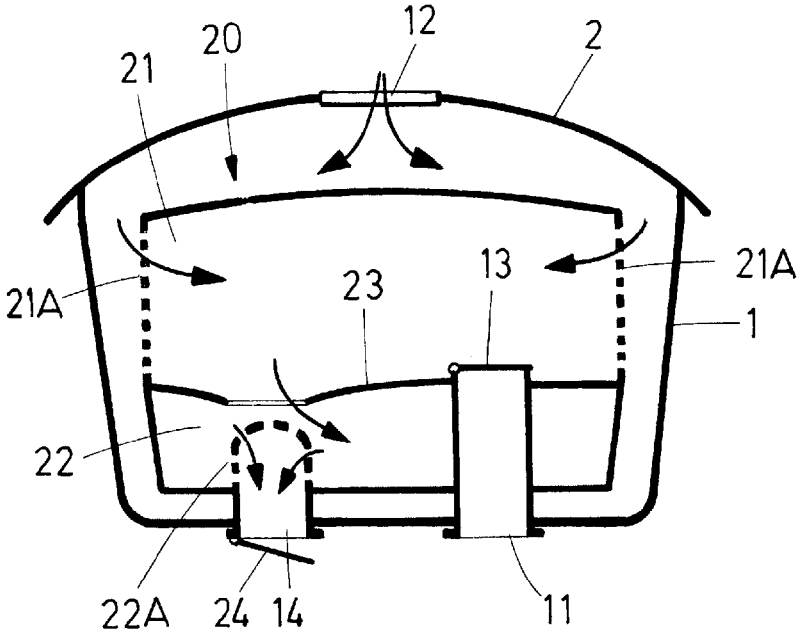

With time, debris starts to accumulate inside the first chamber 21 and, due to the movement of the water, also on the filtering walls 21A, which tend to get clogged. Thus, to prevent reduction of the hydraulic efficiency, the swimming pool cleaner can be set into a second operation mode, namely, a backwash mode, for example, by reversing operation of the pump, or by stopping operation of the pump and instead activating another pump. In the backwash mode, the water flows as illustrated in FIG. 1C, that is, water enters through the first water outlet 12 (which can include some kind of filtering means to prevent debris from being sucked into the device), enters the first chamber 21 through the filtering walls 21A (thereby removing debris from them due to the backwash effect) and enters the second chamber 22, thereby carrying at least part of the debris from the first chamber 21 to the second chamber 22, where it is retained when the water exits through the filtering wall 22A and the second water outlet 14. Next, the pool cleaner can return to the first operation mode, that is, the normal cleaning mode, illustrated in FIG. 1B. As at least part of the debris has been transferred from the first chamber 21 to the second chamber 22, this part of the debris will no longer be in the path along which water flows when pumped from the water inlet 11 to the first water outlet 12, thereby enhancing the hydraulic performance. This increases efficiency and the time between manual cleaning by a user, and reduces the risk that the pool cleaner will stop operating during a cleaning cycle due to excessive clogging of the filter. Of course, now and then it will be necessary to remove the debris from the second chamber. In some embodiments of the invention, this can be done by opening the cover 2 and removing the entire filter 20, with the first and the second chambers, and proceed to cleaning them in a conventional manner. For example, the filter 20 can be provided with one or more lids that can be opened to allow for debris to be removed.

Figure 2:
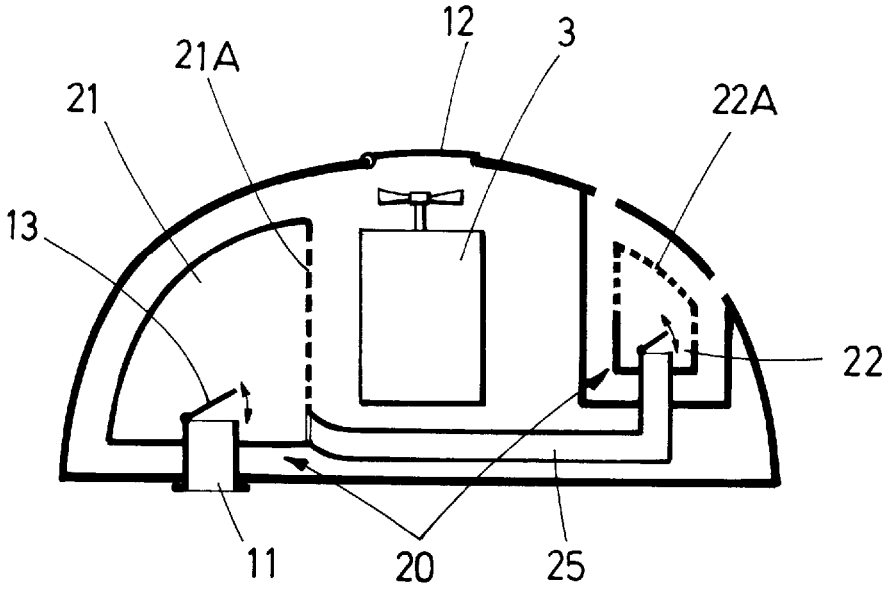
FIG. 2 schematically illustrates a swimming pool cleaner according to another embodiment of the invention.

FIG. 2 schematically illustrates a second embodiment of the invention. The swimming pool cleaner according to this embodiment includes a water inlet 11 and a water outlet 12, and a filter comprising a first chamber 21 having a filtering wall 21A and a second chamber 22 having a filtering wall 22A. In some embodiments of the invention, the second chamber 22 is housed within the housing of the swimming pool cleaner. For example, the second chamber can be accessible through some kind of cover, for example, so as to be removable for cleaning. In some other embodiments of the invention, the second chamber is placed outside the housing of the swimming pool cleaner, for example, as an external accessory that can be connected to the body of swimming pool cleaner. This provides for simple removal and cleaning of the second chamber, and can make it easy for a user to observe, for example, from above and without taking the swimming pool cleaner out of the swimming pool, to what extent the second chamber has been filled with debris and may require cleaning.

The first and the second chambers of the filter are connected by means of a conduit 25. When operating in a first operation mode, the pump 3 pumps water so that water enters through the water inlet 11 and the non-return device 13, into the first chamber 21, where the water passes through the filtering wall 21A and out through the water outlet 12. Debris is retained by said filtering wall 21A. With time, the accumulation of debris causes clogging of the filtering wall 21A and thus reduces the hydraulic efficiency. Therefore, to prevent or reduce the clogging, the swimming pool cleaner is set into the second operation mode, during which the pump 3 pumps water from the outlet 12 into the first chamber 21 through said filtering wall 21A, thereby reducing clogging. As the non-return device 13 prevents the water from exiting the housing through the water inlet 11, the water is pumped through the conduit 25, moving at least part of the debris contained in the first chamber 21 into the second chamber 22. Here, water exits the filtering wall 22A which can be in communication with the outside of the pool cleaner or even be placed outside the housing of the pool cleaner. In this second embodiment, for manual cleaning, it can often be enough that the users removes the second chamber 22, as the first chamber 21, and especially its filtering wall 21A, can often be sufficiently cleaned due to the backwash effect described above.

In both of the embodiments described above, the change between the first operation mode and the second operation mode can take place at predetermined intervals, or as a response to a detection of clogging, for example, as a response to an increase in the power consumption of the pump.

Figure 3A:
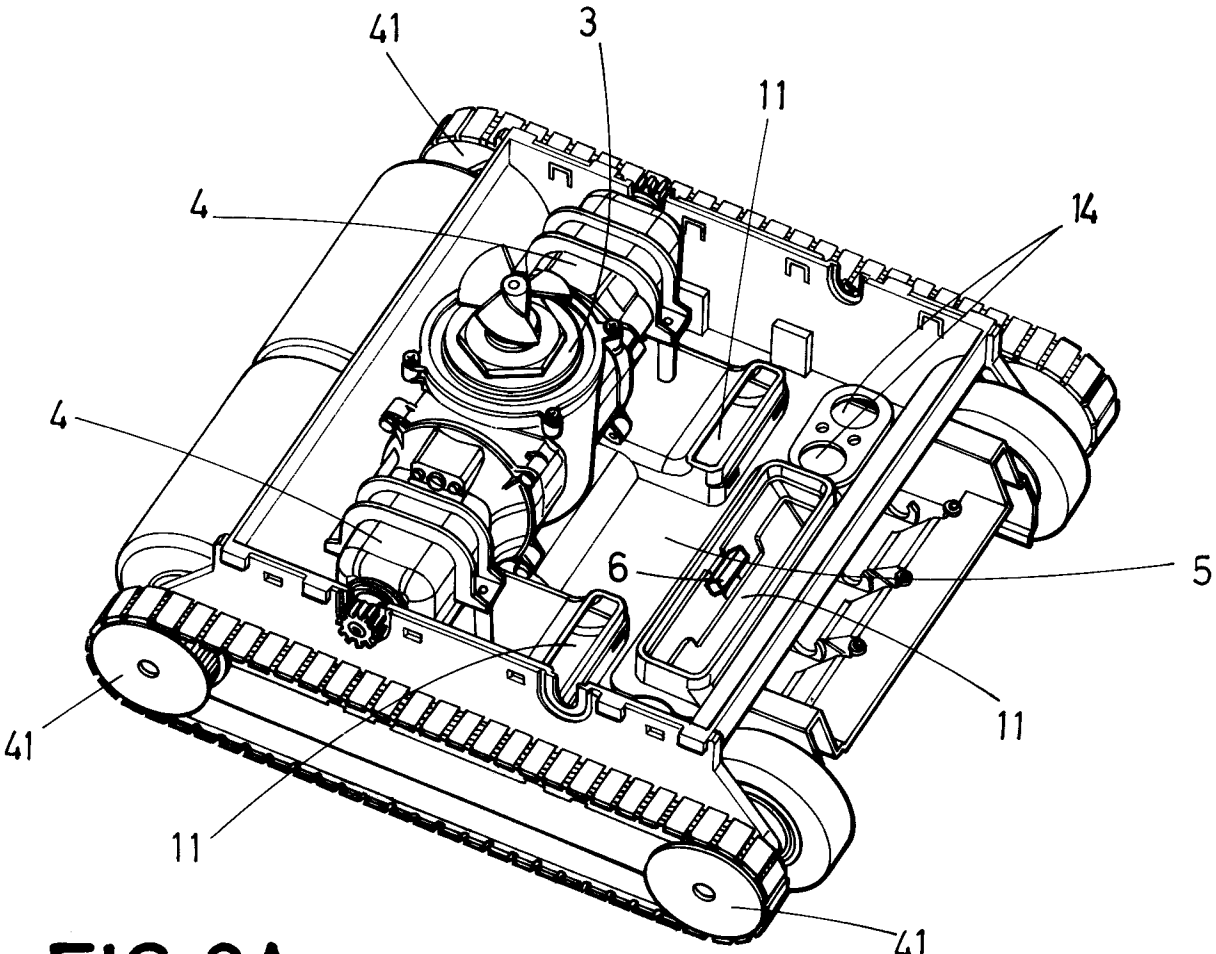
FIGS. 3A and 3B are perspective views from above and below, respectively, of part of a swimming pool cleaner according to an embodiment of the invention.
Figure 3B:
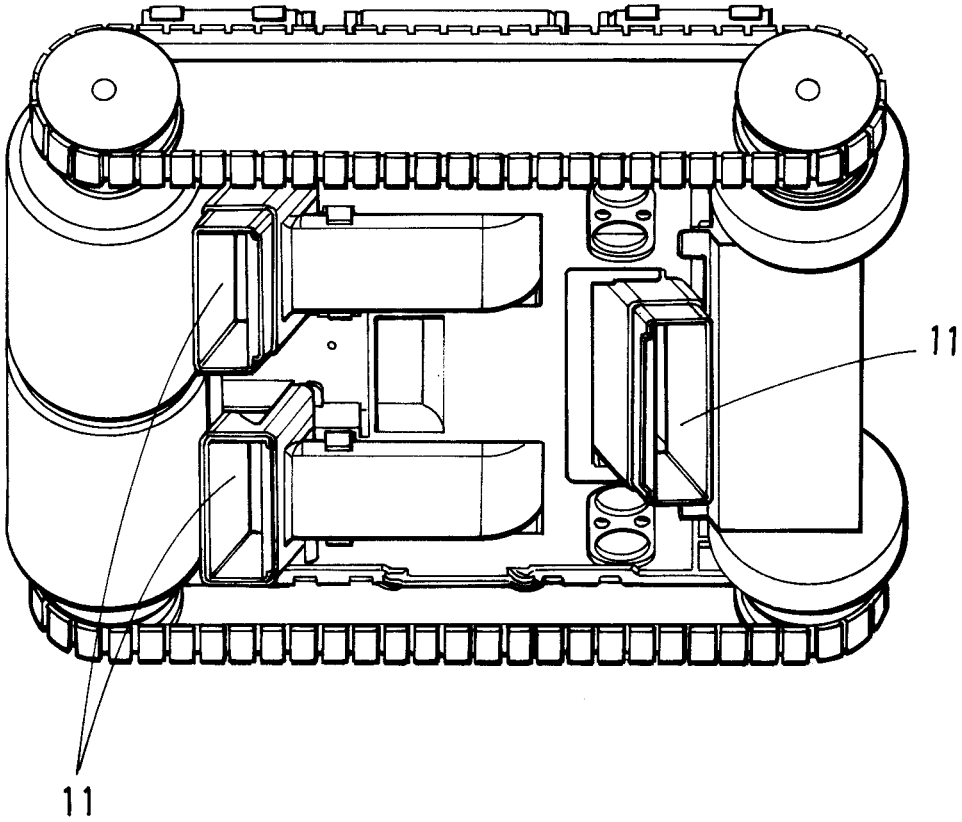

FIGS. 3A and 3B illustrate an embodiment of the invention in which wheels 41 are driven by two electrical motors 4, arranged on respective sides of a pump 3 which is arranged to pump the water according to the principles described above, both in the first operation mode and in the second operation mode. The motors 4 and the pump 3 are arranged within a frame structure of the housing, with a substantial space 5 being available for accommodating the filter. Although the illustrated embodiment includes electrical motors and wheels for displacing the swimming pool cleaner, any other kind of drive means is within the scope of the invention, including hydraulic drive means such as means for displacing the pool cleaner by means of a water jet or similar, and hydraulically driven wheels. Although the pool cleaner of the illustrated embodiment has wheels, also pool cleaners without wheels are within the scope of the invention.

Three water inlets 11 are provided in the floor of the housing, arranged to be connected to the filter system. Also, second water outlets 14 corresponding to those of FIGS. 1A-1C are provided. The inlets are also shown schematically in FIG. 3B; they are placed in different positions both in the longitudinal and in the transversal direction, and can be provided with telescopic members arranged to be moveable in the vertical direction. In FIG. 3A, the dirt detector 6 is illustrated schematically. It is placed in correspondence with one of the water inlets, so as to allow for detection of dirt in the water that is entering the filter.

Figure 4A:
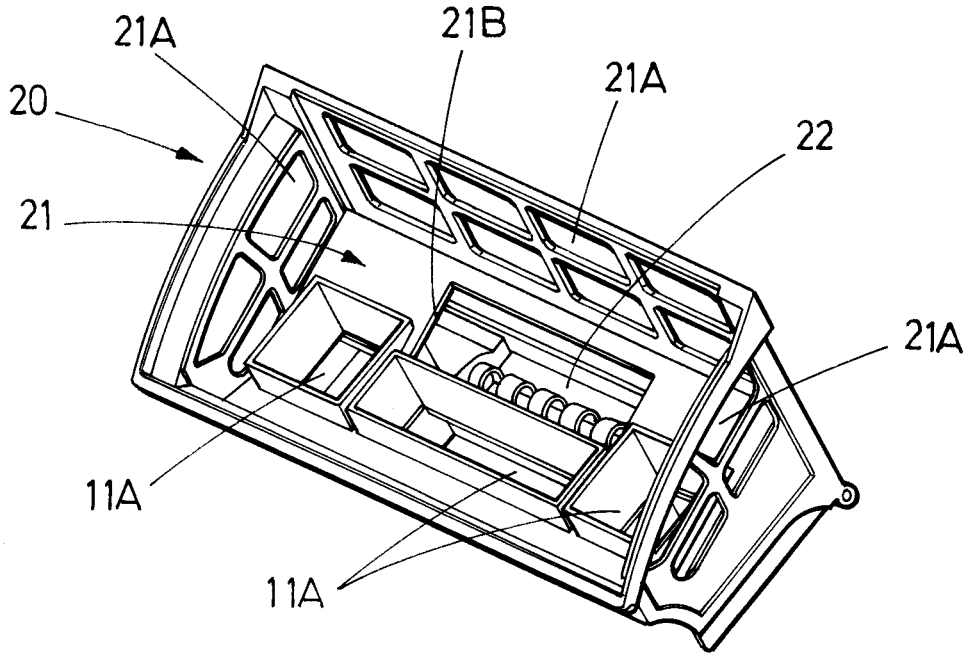
FIGS. 4A-4C are two perspective views and one cross sectional view of a filter system that can be used in the swimming pool cleaner of FIGS. 3A and 3B.
Figure 4B:
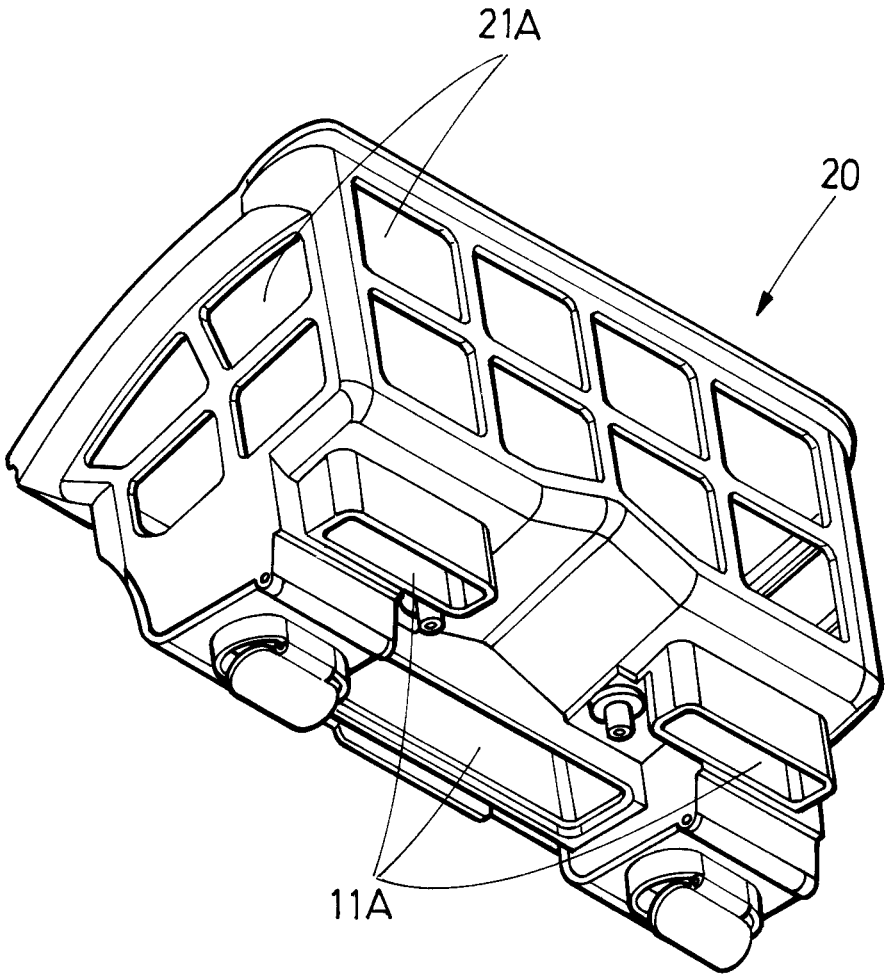
Figure 4C:
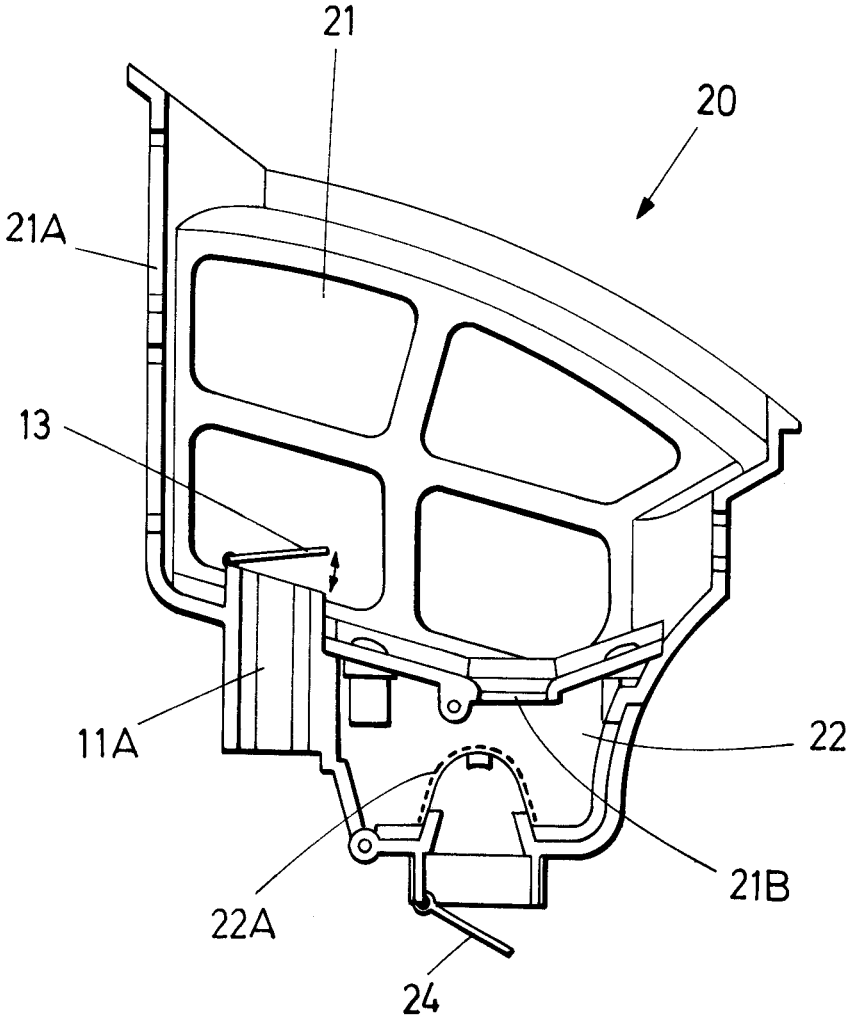

FIGS. 4A-4C illustrate how the filter 20 can comprise inlets 11A arranged to be positioned in correspondence with the water inlets 11 of the pool cleaner, so as to lead water from said water inlets 11 into a first chamber 21 of the filter, which comprises filtering walls 21A and optionally a cover which may or may not be a filtering cover. Alternatively, the first chamber 21 can simply be closed from above by a pivotable or removable cover of the housing of the pool cleaner. Non-return flaps 13 (one of which is schematically illustrated in FIG. 4C) can be provided in correspondence with the inlets 11A.

In this embodiment of the invention, the second chamber 22 is situated below the first chamber 21, and accessible through an opening 21B in the bottom of the first chamber. An outlet is provided at the bottom of the second chamber, covered by a filtering wall 22A of the second chamber, and optionally provided with a non-return device or flap 24. In this embodiment of the invention, no non-return device is provided at the opening 21B between the first chamber and the second chamber.

In the first operation mode, the pump 3 pumps water from the water inlets 11, through inlets 11A, and into the first chamber 21, through the filtering walls 21A and out through an outlet (not shown) in the cover of the housing. At certain intervals, for example, at predetermined intervals or responsive to a detection of clogging of the filtering walls 21A, the pump enters into a reverse mode, driving water from the outlet in the housing and through the filtering walls 21 A into the first chamber 21, reducing the clogging of said filtering walls. Here, anti-return flaps 13 prevent the water from leaving the first chamber 21 through the inlets 11A, thereby forcing the water to follow another path, namely, through opening 21 B, so that the water enters the second chamber 22, whereby debris is moved from the first chamber 21 into the second chamber 22. Here, the water exits through the filtering wall 22A, while debris is retained in the second chamber 22. It can be observed how the filtering wall 22A is formed as a projection rising above the floor of the second chamber, so as to prevent the filtering wall 22A from becoming clogged when debris starts to accumulate. The non-return device 24 prevents water from entering the second chamber from outside the pool cleaner, when the pool cleaner is operating in the first operation mode.

When it becomes necessary to clean the filter manually, the user can remove the entire filter system 20, for example, opening a cover and lifting the filter system out of the pool cleaner. In other embodiments of the invention, only part of the filter system is removed for cleaning.

Figure 5A:
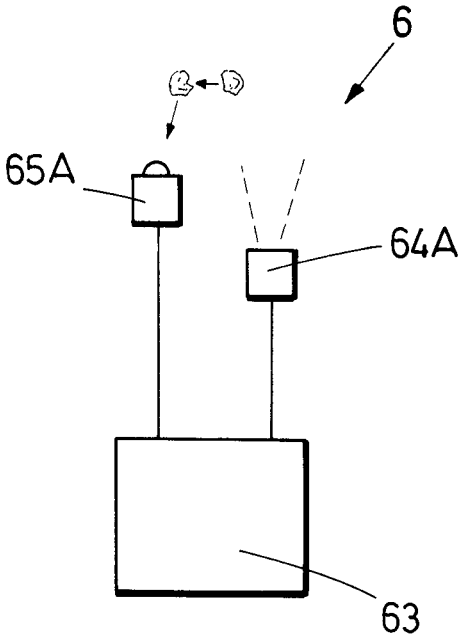
FIGS. 5A and 5B schematically illustrate dirt detectors in accordance with two possible embodiments of the invention.
Figure 5B:
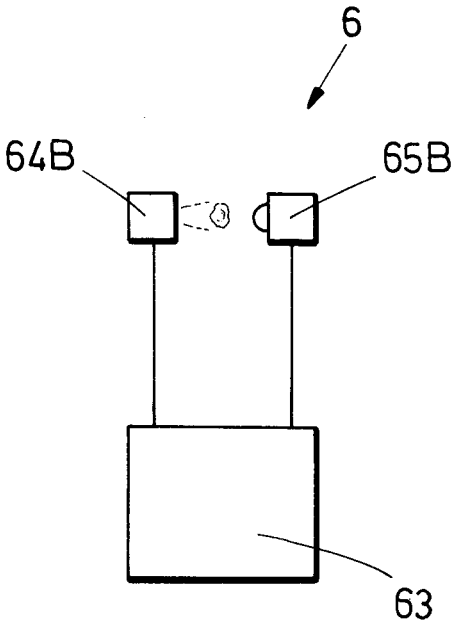

As indicated above, a dirt detector 6 is be provided. The dirt detector can be a turbidity detector, as indicated in FIG. 5A, comprising a light source 64A (such as a LED), and a light sensor 65A arranged for receiving light scattered by dirt particles. A control device 63 is arranged for controlling the operation of the light source and for monitoring the output from the light detector, and the pool cleaner can be arranged to operate according to one of a plurality of available cleaning programs, depending on the output from the light sensor 65A. If the water is clean, only a small amount of light will be reflected so as to arrive at the light sensor. Thus, a high level of the output from the light sensor is indicative of dirt. In other embodiments of the invention, such as in the one schematically illustrated in FIG. 5B, the dirt detection is based on transmitted light, that is, the light source 64B is arranged to direct light towards the light sensor 65B, and a low level of the output from the light sensor may then be indicative of dirt.

Figure 6:
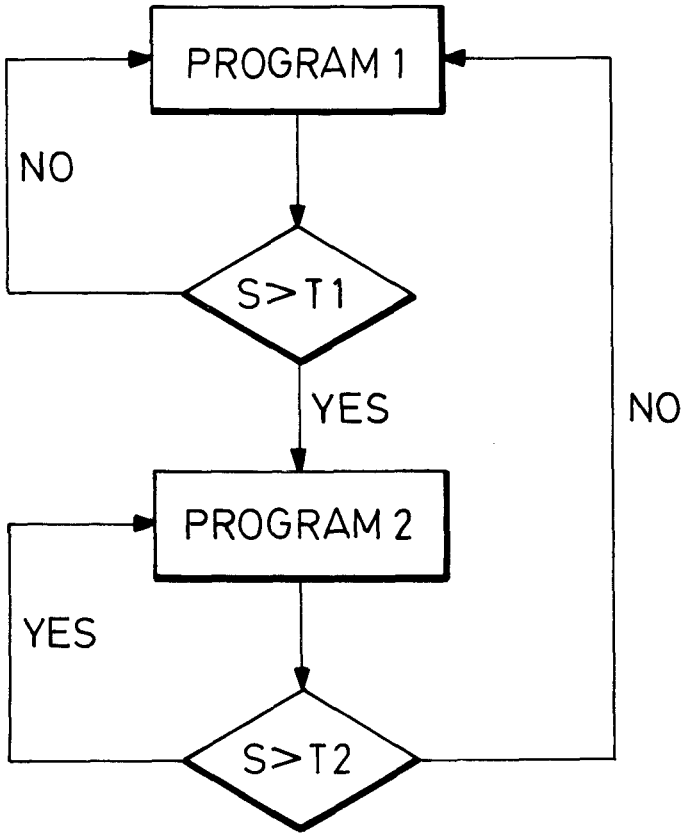
FIG. 6 illustrates how a swimming pool cleaner with a dirt detector can operate, according to an embodiment of the invention.

FIG. 6 schematically illustrates how a pool cleaner in accordance with this embodiment of the invention may operate, in response to the output from the light sensor of a dirt detector. The pool cleaner is programmed with two different cleaning programs, a first one of which has been selected or designed for the treatment of less dirty areas of the swimming pool, and a second one of which has been selected or designed for the treatment of more dirty areas of the swimming pool. For example, the second program may include operating the motors of the pool cleaner for driving back and forth or following a special scanning pattern, different from the one used in the first program, and/or operating the motors of the pool cleaner for driving the pool cleaner at a speed different from the one at which it is driven in accordance with the first program. The pool cleaner may initiate its operation in the first cleaning program, and while operating in accordance with said first cleaning program, the light source 64A/64B generates light and an output from the light sensor is monitored. If the output signal S is below a first threshold T1, the pool cleaner continues to operate in accordance with the first cleaning program. If the output from the light sensor rises above said first threshold T1, the pool cleaner switches to the second cleaning program (differing from the first cleaning program in terms of, for example, the speed with which the pool cleaner is made to move, and/or the scanning pattern that the pool cleaner is made to follow), where it remains until the output from the light sensor falls below a second threshold T2. In order to prevent frequent switching between cleaning programs, hysteresis can be provided so that T2 is sufficiently lower than T1.

In the embodiments illustrated above, the filters comprise two distinct chambers separated by an opening. In other embodiments of the invention, the filter may comprise three or more chambers. In some embodiment of the invention, the filter comprises one chamber having two parts and a configuration that provides, in combination with the arrangement of the pump, that in the first operation mode debris is brought from the water inlet to a first part of the chamber (such as an upper part of the chamber, such as a part of the chamber placed near a water outlet where water leaves the cleaner in the first operation mode), and in the second operation mode, debris is brought from said first part of the chamber to a second part of the chamber (such as a lower part of the chamber and/or a part of the chamber placed towards the front, rear and/or a side of the swimming pool cleaner), the design of the filter being such that once the debris is in the second part of the chamber, the water flow in the first operation mode will not substantially carry said debris back to said first part. Whereas the use of at least two chambers may often be preferred due to simplicity of design and reliability, the use of one chamber with a first and a second part as described can also be appropriate and may involve advantages, for example, in terms of simplicity when it comes to cleaning the entire filter. In some embodiments of the invention, the first part may be placed above the second part, and/or the first part and the second part are placed differently in a longitudinal or transversal direction.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiment(s) described herein, but also encompasses any variations that may be considered by any person skilled in the art (for example, as regards the choice of materials, dimensions, components, configuration, etc.), within the general scope of the invention as defined in the claims.

The invention claimed is:

1. A swimming pool cleaner comprising:

a housing;

drive means for displacing the swimming pool cleaner;

at least one water inlet;

at least one water outlet;

at least one filter; and at least one pump; wherein said water inlet, water outlet, filter and pump are arranged so that in a first operation mode of the swimming pool cleaner, said at least one pump displaces water from said water inlet to said water outlet through said filter, so that debris entering through the water inlet with the water is retained in said filter; and wherein the swimming pool cleaner further comprises a dirt detector that is arranged adjacent to a water inlet and configured to detect debris suspended in the water entering the filter, the swimming pool cleaner being arranged to select, as a function of an output from said dirt detector, one of a plurality of available cleaning programs, and selectively operate according to the selected program.

2. The swimming pool cleaner according to claim 1, wherein at least one of said available cleaning programs is arranged for driving the swimming pool cleaner, via said drive means, with a first speed, and wherein at least another one of said available cleaning programs is arranged for driving the swimming pool cleaner, via said drive means, with a second speed, different from said first speed.

3. The swimming pool cleaner according to claim 1, wherein at least one of said available cleaning programs is arranged for driving the swimming pool cleaner in accordance with a first scanning pattern and wherein at least another one of said available cleaning programs is arranged for driving the swimming pool cleaner in accordance with a second scanning pattern, different from said first scanning pattern.

4. The swimming pool cleaner according to claim 1, wherein the dirt detector comprises a turbidity sensor.

5. The swimming pool cleaner according to claim 1, wherein the dirt detector is arranged within the housing of the swimming pool cleaner.

6. The swimming pool cleaner according to claim 1, wherein the dirt detector is further arranged to detect debris suspended in water drawn towards the inlet.

7. The swimming pool cleaner according to claim 1, wherein the dirt detector is further arranged to detect debris suspended in water beneath the cleaner.

* * * * *